United States Patent [19]

Wells et al.

[11] Patent Number: 4,862,532

[45] **Date of Patent: * Sep. 5, 1989**

[54] BEDDING FOUNDATION HAVING SNAP-IN PLACE SINUOUS WIRE SPRINGS

[75] Inventors: Thomas J. Wells, Carthage, Mo.; Angelo Serafini, East Boston, Mass.; Sidney A. Hiatt; Henry Zapletal, both of Carthage, Mo.

[73] Assignee: Leggett & Platt, Incorporated, Carthage, Mo.

[ * ] Notice: The portion of the term of this patent subsequent to Aug. 2, 2005 has been disclaimed.

[21] Appl. No.: 144,819

[22] Filed: Jan. 15, 1988

[51] Int. Cl.[4] ..... A47C 23/04

[52] U.S. Cl. ..... 5/247; 5/255; 5/267; 5/277

[58] Field of Search ..... 5/247, 255, 267, 268, 5/272, 273, 276, 277, 476; 267/80, 86, 95, 100, 103–109

[56] References Cited

U.S. PATENT DOCUMENTS

| | | | |
|---|---|---|---|
| 2,105,115 | 1/1938 | Gleason . | |
| 2,116,402 | 5/1938 | Menge . | |
| 2,526,250 | 10/1950 | Matthaei, Jr. . | |
| 2,705,527 | 4/1955 | Flint et al. . | |
| 2,798,233 | 7/1957 | Robell . | |
| 2,826,768 | 3/1958 | Drews . | |
| 2,979,739 | 4/1961 | Krakauer . | |
| 3,325,831 | 6/1967 | Crosby et al. . | |
| 3,577,574 | 5/1971 | Ciampa et al. . | |
| 3,725,965 | 4/1973 | Smith et al. | 5/247 X |
| 3,825,960 | 7/1974 | Inman et al. . | |
| 3,833,948 | 9/1974 | Surletta et al. . | |
| 3,835,485 | 9/1974 | Klicki . | |
| 3,953,903 | 5/1976 | Lawrence et al. | 5/267 |
| 3,990,121 | 11/1976 | Whitaker . | |
| 4,100,631 | 7/1978 | Slone . | |
| 4,101,993 | 7/1978 | Yates et al. | 5/263 X |
| 4,236,262 | 12/1980 | Spiller | 5/267 |
| 4,426,070 | 1/1984 | Garceau et al. | 267/110 X |
| 4,555,097 | 11/1985 | Hiatt . | |
| 4,704,752 | 11/1987 | Yates et al. . | |
| 4,730,358 | 3/1988 | Zapletal . | |
| 4,760,616 | 8/1988 | Hiatt et al. | 5/255 X |
| 4,770,397 | 9/1988 | Schulz, Jr. | 267/103 X |

*Primary Examiner*—Michael F. Trettel

*Attorney, Agent, or Firm*—Wood, Herron & Evans

[57] ABSTRACT

A box spring assembly includes a base frame, a top wire grid and a plurality of sinous wire springs interconnecting the top wire grid and the base frame. The sinuous wire springs each comprises a sinuous wire strip formed into an inverted U-shaped configuration with the closed end of each U-shaped spring attached to the top wire grid by a snap-fit connection and the free ends at the bottom of the U-shaped spring being attached to the base frame.

23 Claims, 3 Drawing Sheets

FIG. 3
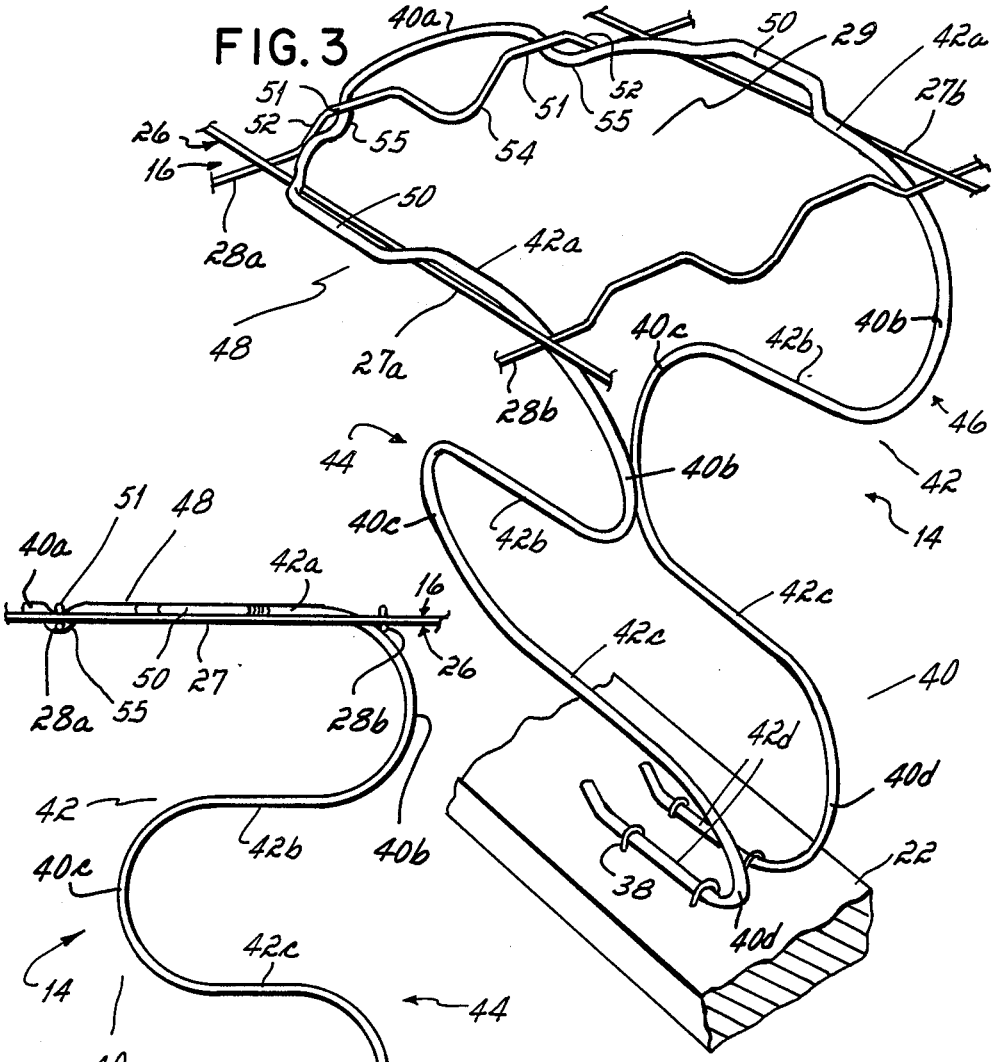
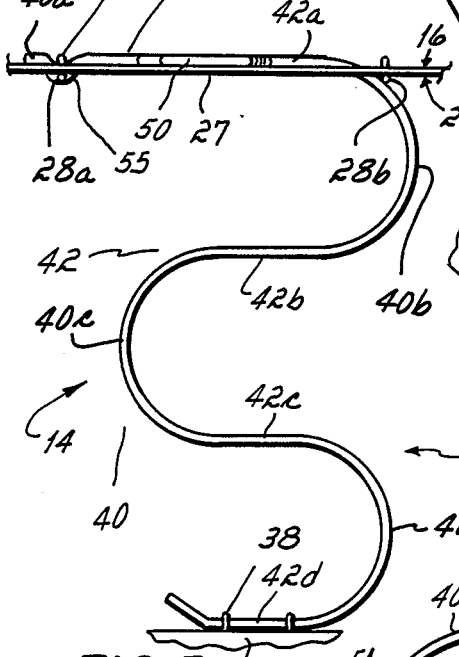
FIG. 5
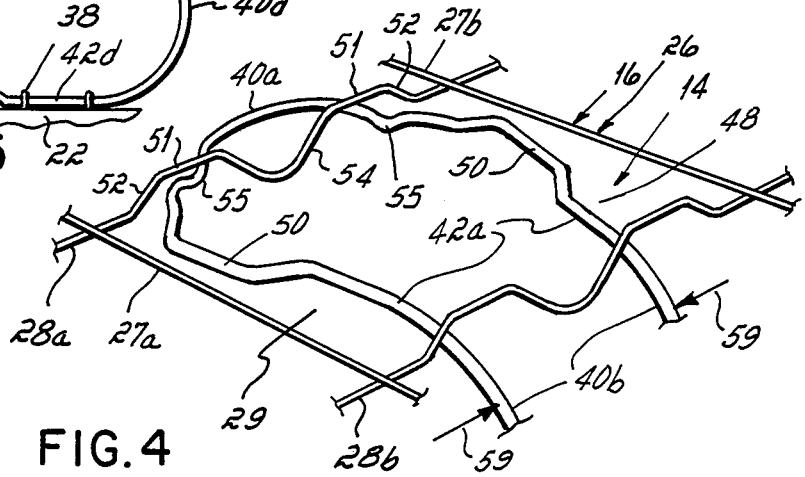
FIG. 4

BEDDING FOUNDATION HAVING SNAP-IN PLACE SINUOUS WIRE SPRINGS

This application is an improvement upon the box spring assembly disclosed in the assignee's earlier U.S. patent application Ser. No. 030,461 filed Mar. 25, 1987, now U.S. Pat. No. 4,730,358 and application Ser. No. 038,503, filed Apr. 15, 1987, now U.S. Pat. No. 4,760,616.

This invention relates to bedding foundations, and more particularly, to a box spring style of bedding foundation.

Prior art box springs or bedding foundations have generally included coil springs positioned in a vertical orientation so as to provide resilient support for a bedding mattress. In an effort to improve upon these conventional coil spring types of box spring or bedding foundation assemblies, numerous prior art assemblies have been developed which substitute formed wire springs for the more traditional coil springs. "Formed wire" springs is an art term used to describe springs which derive their resiliency from torsion bars rather than coils. Examples of formed wire springs embodied in box spring assemblies are to be found in U.S. Pat. Nos. 3,825,960; 3,833,948; and 3,835,485. Additionally, some prior art box spring assemblies have been developed which included combinations of coil and formed wire springs, as for example, the box spring assembly shown in U.S. Pat. No. 3,990,121. In those instances wherein formed wire springs and coil springs have been combined in a box spring, the formed wire springs have usually functioned to impart additional firmness to selected areas of the box spring, as for example, around the edge of the box spring or in the center section of the box spring.

A common problem with all box springs which utilize formed wire springs is that those box springs are relatively expensive to manufacture, primarily because the equipment upon which the formed wire spring portions of the box spring are manufactured are usually capable of making only one bend per stroke of a forming machine. Consequently, the formed wire springs, which generally have multiple bends formed therein, are expensive to produce, and the resulting box spring includes an expensive configuration of multiple formed wire springs.

It has therefore been an objective of this invention to provide an improved box spring which utilizes a novel formed wire spring to provide resilient support of the load supporting surface of the box spring, but which formed wire spring is relatively inexpensive to manufacture.

Still another objective of this invention has been to provide an improved box spring which has all of the resiliency and selective firmness characteristics of prior art box springs, but which may be manufactured and sold substantially less expensively.

The improved box spring of this invention utilizes formed wire springs. These formed wire springs are made from sinuous wire strips of the type having oppositely facing edge loops interconnected by straight torsion bar sections. According to the practice of this invention, these strips are bent into an inverted U configuration having vertical legs interconnected by a flat top section. The lower free ends of the vertical legs of the sinuous spring strips are, according to the practice of this invention, attached to the base frame, and the flat top interconnecting sections of the strip are connected to the wire grid of the box spring assembly. Thus, the sinuous wire springs provide a resilient support for the load bearing top wire grid of the box spring.

According to the practice of this invention, the tops of these inverted, U-shaped, sinuous wire springs are snap-fit into rectangular pockets of the top wire grid so that there is no need for metal clips or other formed connectors for securing the sinuous wire springs to the grid.

Sinuous wire spring strips are very commonly used to form resilient load supporting portions of furniture seats. In fact, very nearly all automobile seats incorporate sinuous spring strips as the resilient load portion of both the seat and the backrest of the seat assembly. Consequently, the equipment for manufacturing sinuous wire spring strips is very highly developed, and such springs may therefore be very economically manufactured. This invention takes advantage of the technology for inexpensively manufacturing sinuous wire spring strips to reduce or minimize the cost of box spring assemblies by utilizing formed wire springs manufactured from sinuous wire spring strips for at least a portion of the resilient load supporting elements of the box spring.

Sinuous wire spring strips have in the past been utilized to provide edge support for a mattress or box spring. Examples of such edge supported sinuous wire springs may be found in U.S. Pat. Nos. 2,105,115; 2,826,768; and 2,798,233. To our knowledge, though, and except as disclosed in the assignee's co-pending U.S. patent application Ser. No. 030,461 of Henry Zapletal, now U.S. Pat. No. 4,730,358, and U.S. patent application Ser. No. 038,503 of Sidney Hiatt, et al., now U.S. Pat. No. 4,760,616 sinuous wire spring strips have never been formed into generally U-shaped wire springs for providing the resilient support between a top wire grid and a bottom frame of a box spring.

In the above-identified application, 732,373, now abandoned there is disclosed a U-shaped sinuous wire spring used in a bedding box spring. As disclosed in that application, the closed end of the U-shaped spring is attached to the base frame of the box spring, and the open end is attached to the wire grid. In the above-identified U.S application, Ser. No. 038,503, now U.S. Pat. No. 4,760,616 the U-shaped sinuous wire spring is inverted so that the closed end is attached to the wire grid and the open end is attached to the base frame. The inverted construction wherein the closed end of the U-shaped spring is attached to the grid enables the arcuate top section of the spring to be fitted into a radiused corner of the box spring and attached to the radiused corner of the border wire of the grid. Additionally, the inverted orientation of the U-shaped sinuous wire spring enables the spring to be mounted upon a narrow transverse slat of the base frame because the free ends of the spring may be placed in a close, but spaced, adjacency and attached to a narrow transverse slat of the base frame.

The invention of this application is an improvement upon the second box spring construction described hereinabove wherein the inverted U-shaped sinuous spring has the closed end of the spring attached to the wire grid. According to the practice of this invention, the closed end of the spring is snap-fit into the grid so that no accessories, such as clips or special tools, are required for making the connection.

These and other objects and advantages of the present invention will be more readily apparent from the following description of the drawings, in which:

FIG. 3 is an enlarged perspective view of one portion of the box spring assembly of FIG. 2.

FIG. 4 is a view similar to FIG. 3 illustrating how a top of a sinuous wire spring is snap-fit into a pocket of a welded wire grid in accordance with the practice of this invention.

FIG. 5 is an end elevational view, on a reduced scale, of the portion of the box spring assembly illustrated in FIG. 3.

Figure 1:
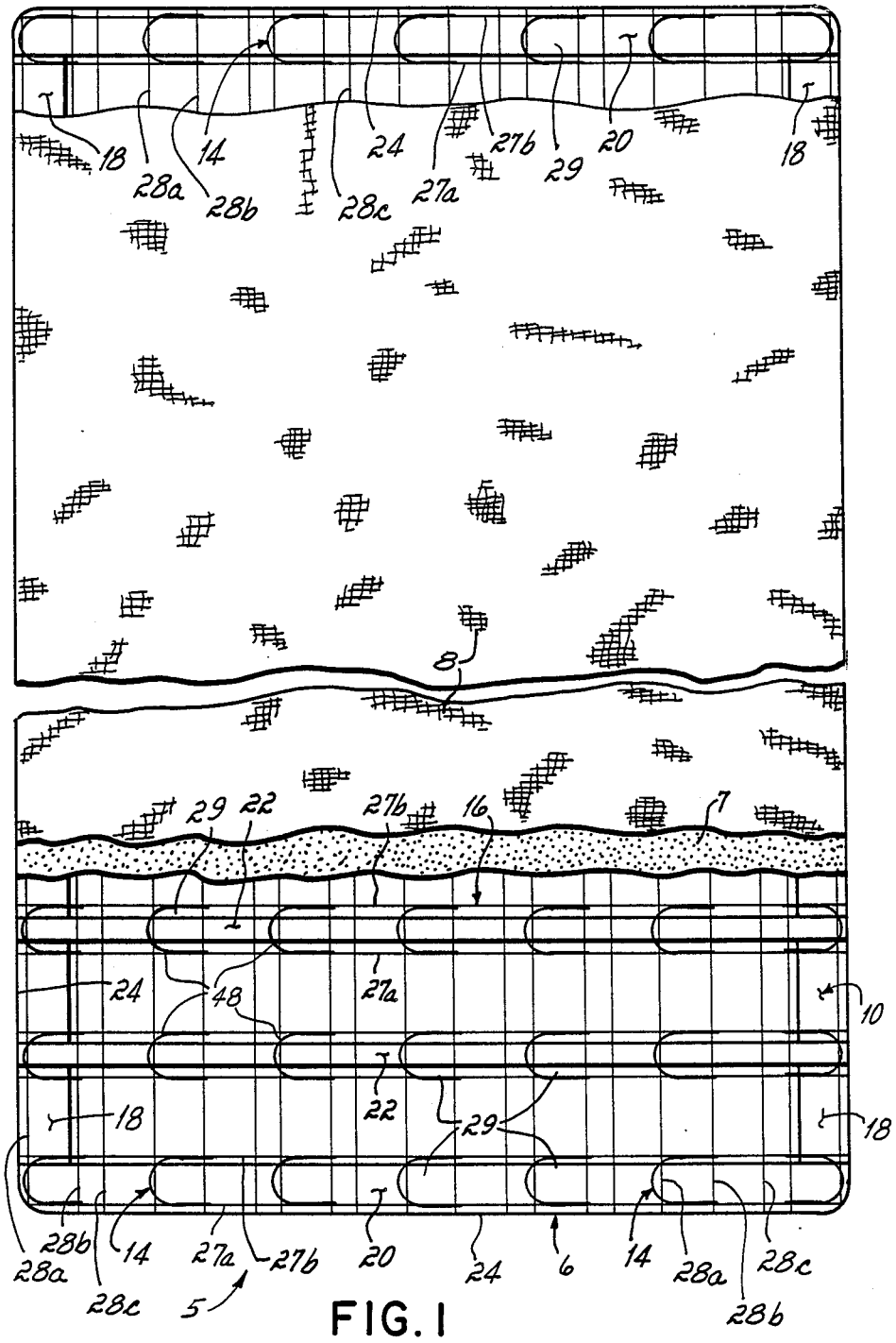
FIG. 1 is a top plan view, partially broken away, of a box spring incorporating the invention of this application.
Figure 2:
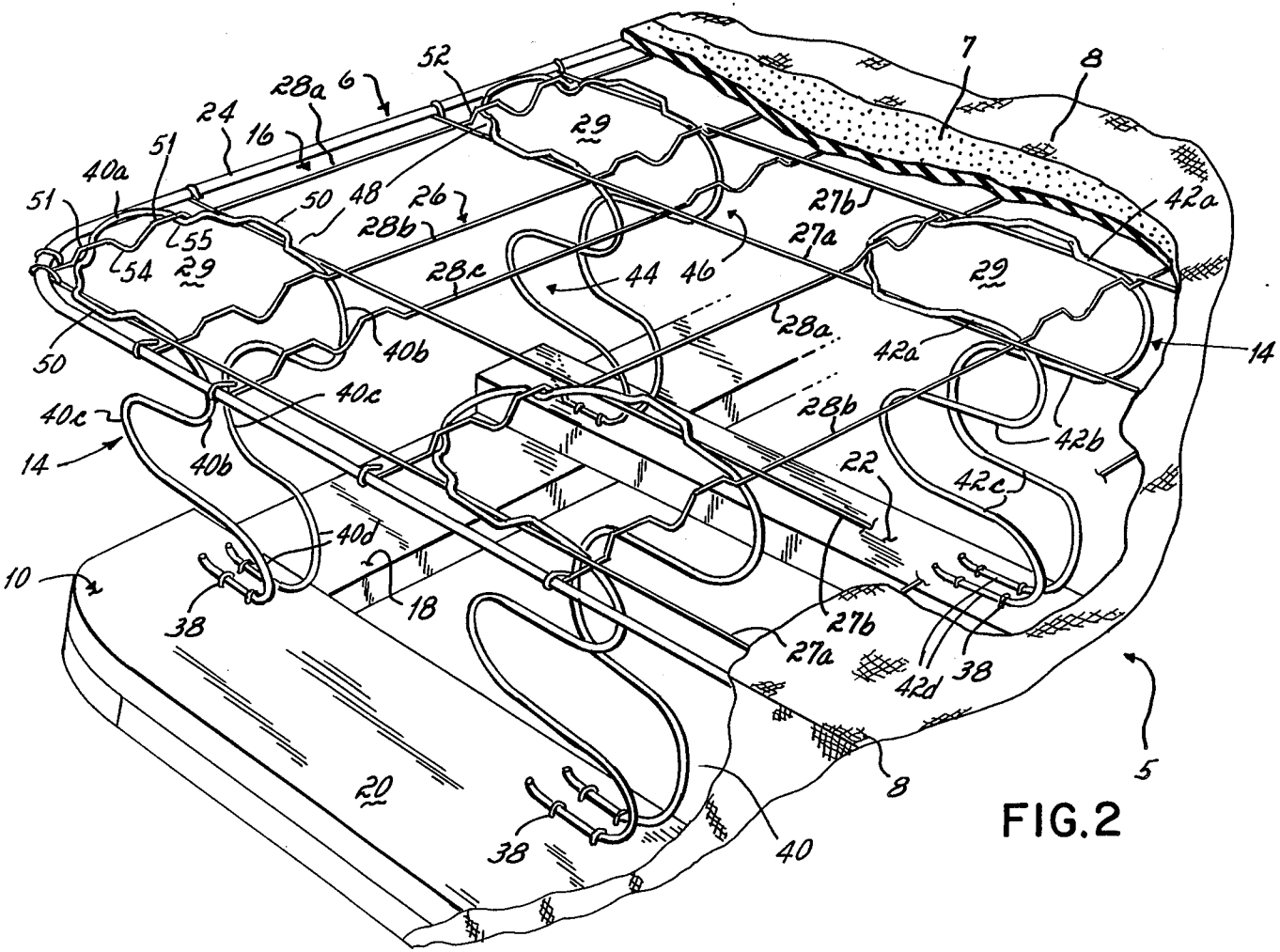
FIG. 2 is a perspective view of one corner portion of the box spring assembly of FIG. 1.

With reference first to FIGS. 1–3, it will be seen that the bedding foundation or box spring 5 of this invention includes a box spring assembly 6 over the top of which padding 7 is placed. The box spring assembly 6 and padding 7 are encased in an upholstered covering 8.

The box spring assembly 6 comprises a wooden base frame 10 upon the top of which there is mounted a plurality of sinuous wire springs 14 for supporting a top wire grid 16. The top wire grid 16 is intended to resiliently support a mattress as is conventional in the bedding industry.

The base frame 10 is rectangular in configuration and comprises a pair of longitudinally extending side boards 18 (FIG. 2), as well as a pair of transversely extending end boards 20, nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid assembly 16 comprises a border wire 24 and a welded wire grid 26. The border wire 24 is formed into a rectangular configuration and overlies the peripheral edge of the rectangular base frame. The welded wire grid 26 is secured to and located in the plane of the border wire 24, the grid and border wire defining the top plane of the box spring assembly. The welded wire grid 26 comprises a plurality of spaced, transverse wires 27 and a plurality of spaced, longitudinal wires 28. The transverse wires 27 are arranged in pairs **27*a*, 27*b*, and except for intervening reinforcement wires 28*c*, the longitudinal wires 28 are similarly arranged in pairs 28*a*, 28*b*. All of the wires 27 and 28 of the welded wire grid 26 extends between opposite sides and ends, respectively, of the rectangular border wire 24. These grid wires overlie the rows and columns of sinuous wire springs 14 so as to secure the top of those springs 14 against lateral and longitudinal displacement. The edgemost ones of the transverse wires 27 and longitudinal wires 28 lie in close adjacency and parallel to the border wire so as to provide edge support of the border wire from the springs 14** which are snap-fit into pockets of the wire grid defined by these edgemost wires as explained more fully hereinafter.

The ends of all the grid wires 27, 28 are hooked around the border wire 24 and are preferably welded to the border wire. The intersections or cross-over points of the transverse wires 27 and the longitudinal wires 28 are welded together, thereby providing a matrix of pockets 29 contained within an integral welded wire top grid. In manufacture, the border wire 24 and the welded wire grid 26 are all preformed into a welded top wire grid 16 subassembly.

The top wire grid 16, including the four radiused corners, is connected to the wooden frame by the sinuous wire springs 14. With particular reference to FIGS. 2 and 3, it will be seen that each of these sinuous wire springs 14 comprises a sinuous wire spring strip made from wire bent back and forth upon itself into a conventional sinuous form so as to have oppositely facing edge loops 40 interconnected by straight torsion bar sections 42. According to the practice of this invention, each of these sinuous spring strips is formed into a generally inverted U-shaped configuration having substantially vertical legs 44, 46 interconnected at the top by a substantially flat top section 48. The substantially flat top section 48 of each spring comprises a single edge loop **40*a* and a pair of torsion bar sections 42*a* extending from the opposite ends of the top edge loop 40*a*. The ends of these two torsion bar sections 42*a* remote from the top edge loop 40*a* are connected to the vertical legs 44, 46 of the spring. In the practice of this invention, the torsion bars 42*a* each have an outwardly extending offset 50** formed therein.

Each vertical leg comprises three edge loops **40*b*, 40*c* and 40*d* interconnected by a pair of straight torsion bar sections 42*b*, 42*c*. The bottommost edge loop 40*d* in turn is connected to a free end torsion bar 42*d* which is connected to the base frame 10 by staples 38**.

In the preferred practice of this invention, the edge loops **40*b*, 40*c* and 40*d* are of the same radius and are of lesser radius than the single edge loop 40*a* of the flat top section 48 of the springs 14. In one practice of the invention, the three edge loops 40*b*, 40*c* and 40*d* of the vertical legs 44, 46 of the springs are each approximately 2.4 centimeters in radius, and the single edge loop 40*a* of the top section of the springs is approximately 4.5 centimeters in radius. The vertical legs 44, 46 of the sinuous springs are, in the preferred practice of this invention, each displaced from a vertical plane through the straight torsion bars 42*a* by approximately 15°. In other words, both legs 44, 46 slope inwardly from the torsion bars 42*a* toward one another such that the torsion bars 42*a* are spaced apart approximately 9 centimeters, and the free end torsion bars 42*d* of each sinuous spring 14 are spaced apart by approximately 1.5 centimeters. The sinuous springs 14** are approximately 14 centimeters in height.

All of the sinuous wire springs 14 are attached at the bottom to the end boards 20 or slats 22 of the base frame by staples 38 over the torsion bars **42*d*. At the top, all of the sinuous springs are attached to the grid 16 by having the substantially flat top sections 48 of the springs snap-fit into pockets 29 of the grid defined by intersecting pairs of transverse wires 27*a*, 27*b* and longitudinal wires 28*a*, 28*b*. To facilitate this snap-fit interconnection of the top sections 48 of the sinuous springs 14 within the pockets 29 of the welded wire grid, it will be noted in FIGS. 3 and 4 that the longitudinal wires 28 pass beneath the transverse wires 27 at the intersections thereof. Between the transverse wires 27, the longitudinal wires 28 have upwardly extending, vertical offsets 51 formed therein. These offsets 51 are preferably of approximately the same height as the diameter of the wire from which the sinuous springs 14 are formed. The length of the offsets 51 is slightly greater than the width of the portion of the top edge loop 40*a* received beneath the offset. As a result of this formation of the offsets 51, the edge loop 40*a* of the top flat section 48** of the spring 14 is entrapped beneath and between the edges 52 of the vertical offset section 51 of the longitudinal wires 28. To ensure that the substantially flat top section 48 of the sinuous springs 14 does not slip out of the pockets 29 of the wire grid within which it is entrapped, the top edge loop 40*a* of the spring preferably has downwardly bent indentations or detents 55 formed at the point at which the top edge loop 40*a* of the sinuous spring 14 passes beneath the wire 28. To further ensure that the flat top section 48 of the spring does not slip out of the pocket 29, the longitudinal wires 28 have a V-shaped indentation 54 formed therein mid-length of the vertical offset 51. This V-shaped indentation 54 extends downwardly from the longitudinal wire 28 in a vertical plane to a depth at least twice, and preferably three times, the diameter of the wire from which the spring 14 is formed.

To assemble the springs 14 with the grid 16, the flat top sections 48 of the sinuous springs 14 are snap-fit into the pockets 29 of the grid by simply squeezing together the top loops 40*b* of the vertical legs 44, 46, as indicated by the arrows 59 in FIG. 4, until the outwardly extending offsets 50 of the torsion bars 42*a* are located internally of the transverse wires 27*a* and 27*b*. The loops 40*b* of the legs 44, 46 are then lifted upwardly until the horizontal offsets 50 are positioned above the wires 27*a*, 27*b*. When so positioned, the force used to squeeze the loops 40*b* together is relieved such that the horizontal offset sections 50 snap out over the transversely extending wires 27*a*, 27*b*. Because the edge loop 40*a* of the substantially flat top section 48 of the spring is then located beneath the longitudinal wire 28*a* with the indentation 55 of that edge loop positioned immediately beneath the longitudinal wire 28*a*, the top loop of the sinuous spring is then fixedly attached to the wire grid. The sinuous spring 14 is then locked to the grid as a consequence of this snap-fit interconnection between the wires of the grid and the substantially flat top planar section of the spring.

In practice, the box spring of FIGS. 1–3 is assembled by first nailing the end boards 20 to the tops of the side boards 18 and by nailing the slats 22 to the tops of these same side boards. The preassembled top wire grid 16 having the springs 14 mounted therein is then fitted over the top of the assembled wooden frame so as to position the bottom section torsion bars 42*d* of the sinuous wire springs atop the base frame. The bottom free end torsion bars 42*d* of the sinuous wire springs 14 are then stapled to the tops of the end boards 20 and the ends of the slats 22.

It is important to note that the edgemost longitudinal and transverse grid wires which partially define the pockets 29 for the edgemost springs 14, are located closely adjacent the border wire 24. In practice, these edgemost grid wires extend parallel to the grid wire but are spaced approximately two centimeters from the border wire 24. The need for this close adjacency positioning of the edgemost grid wires derives from the fact that the border wire is made from such heavy gauge or large diameter wire or rod that it is not suitable for snap-fit connection with the edgemost springs 14. By locating the edgemost grid wires in close adjacency, but spaced from, the border wire, the springs 14 may be snap-fit thereto while still providing vertical edge support for the closely spaced border wire. The edgemost grid wires thus act as an inner border wire extending parallel to, but slightly spaced from, the border wire 24, but of much smaller diameter wire suitable for snap-fit connection with the heads of the springs 14.

To complete the foundation after completion of the box spring assembly, the fabric pad 7 is overlaid over the top of the welded wire grid and the complete assembly, including the rectangular wooden frame, the springs, the top wire grid, and the fabric pad, are enclosed within the upholstered covering 8.

While we have described only one preferred embodiment of our invention, persons skilled in this art will appreciate changes and modifications which may be made without departing from the spirit of my invention. For example, the relative positioning of the snap-fit sinuous wire springs in the box spring assembly may be varied without departing from my invention, or those sinuous wire springs may be mixed with coil springs or other modular springs at selected sites in the assembly. Therefore, we do not intend to be limited except by the scope of the following appended claims.

We claim:

1. A bedding foundation comprising, a bottom, substantially rectangular, base frame having side and end members and slats extending between said side members, a substantially planar rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first an second sets of wires intersecting one another and being fixedly connected to said border wires, a plurality of sinuous wire springs interconnecting said base frame and said wire grid, said sinuous wire springs each comprising a sinuous spring strip made from wire bent back and forth to have oppositely facing edge loops interconnected by straight torsion bar sections, each of said strips being formed into a generally U-shaped configuration having substantially vertical legs interconnected by a substantially flat horizontal section, said flat section of each of said sinuous wire springs being fixedly secured to said wire grid and the ends of said vertical legs of each of said sinuous springs remote from said flat section being fixedly secured to said base frame, each of said vertical legs of each of said U-shaped sinuous wire springs consisting of multiple edge loops interconnected by a torsion bars, the lowermost one of the edge loops being connected to a free end torsion bar, said flat section of each of said U-shaped sinuous wire springs consisting of a single edge loop and a pair of torsion bars connected to opposite ends of said single edge loop, said flat section being connected to said top wire grid by snap-fit connector means, said snap-fit connector means comprising portions of each torsion bar of said pair of torsion bars of said flat section being spring biased outwardly over one wire of one of said first and second sets of wires of said grid and a portion of said single edge loop of said flat section being located beneath one wire of the other of said first and second sets of wires of said grid, a fabric pad overlying said top wire grid, and an upholstered cover surrounding said base frame, top wire grid, sinuous wire springs, and said fabric pad.

2. A bedding foundation assembly comprising, a bottom, substantially rectangular, base frame having side and end members, a substantially planar rectangular top wire grid, said grid comprising a border wire and first and second sets of wires, said first set of wires comprising a plurality of longitudinally extending, spaced, parallel wires, said second set of wires comprising a plurality of transversely extending, spaced, parallel wires, the ends of both said first and second sets of wires being fixedly connected to said border wire, a plurality of sinuous wire springs interconnecting said base frame and said wire grid, said sinuous wire springs each comprising a sinuous spring strip made from wire bent back and forth upon itself to form oppositely facing edge loops interconnected by straight torsion bar sections, said spring strip being formed into a generally U-shaped configuration having substantially vertical legs interconnected by a flat horizontal section, said flat horizontal section of each of said sinuous wire springs being fixedly secured to said wire grid and the ends of said vertical legs of each of said sinuous springs remote from said flat section being fixedly secured to said base frame, and each of said substantially vertical legs of each of said U-shaped sinuous wire springs consisting of multiple edge loops interconnected by torsion bars, the one of the edge loops most remote from the flat section being connected to a free end torsion bar, and said flat section of each of said U-shaped sinuous wire springs consisting of a single edge loop and a pair of torsion bars connected to opposite ends of said single edge loop, said flat section being secured to said top wire grid by snap-fit connector means, said snap-fit connector means comprising portions of each torsion bar of said pairs of torsion bars of said flat section being spring biased outwardly over one wire of one of said first and second sets of wires of said grid and a portion of said single edge loop of said flat section being located beneath one wire of the other of said first and second sets of wires of said grid.

3. The bedding foundation assembly of claim 2 wherein each of said substantially vertical legs comprises three edge loops interconnected by a pair of torsion bars.

4. The bedding foundation assembly of claim 3 wherein said single edge loop is of larger radius than said edge loops of said substantially vertical legs.

5. The bedding foundation of claim 2 wherein each of said pair of torsion bars of said flat section of said sinuous wire springs comprises a straight bar having an outwardly extending offset formed therein.

6. The bedding foundation of claim 2 wherein each of said portions of said single edge loop of said flat section of said sinuous wire springs is located beneath a vertically and upwardly offset section of said one wire of the other of said first and second sets of wires of said grid.

7. The bedding foundation of claim 6 wherein said vertically and upwardly offset section of said one wire is offset upwardly from the plane of said grid by approximately the diameter of the wire from which said sinuous wire spring is formed.

8. The bedding foundation of claim 7 wherein single edge loop of said flat section of said sinuous wire springs has a detent formed therein at the point at which it intersects said vertically and upwardly offset section of said one wire.

9. The bedding foundation of claim 7 wherein each of said vertically and upwardly offset sections has a downwardly extending indentation formed therein approximately medially of the length of said vertically and upwardly offset sections.

10. A bedding foundation assembly comprising, a bottom, substantially rectangular, base frame having side and end members, radiused corners, and slats extending between said side members, a substantially planar rectangular top wire grid, said grid comprising a border wire and first and second sets of wires, said border wire being of rectangular configuration and surrounding said first and second sets of wires, said border wire having radiused corners, said first set of wires comprising a plurality of longitudinally extending, spaced, parallel wires and said second set of wires comprising a plurality of transversely extending, spaced, parallel wires, said first and second sets of wires being fixedly connected to said border wire, a plurality of sinuous wire springs interconnecting the corners of said base frame and said wire grid, said sinuous wire springs each comprising a sinuous spring strip made from wire bent back and forth to have oppositely facing edge loops interconnected by torsion bar sections, each of said strips being formed into a generally U-shaped configuration having substantially vertical legs interconnected by a substantially flat section, said flat section of each of said sinuous wire springs being secured to said top wire grid and the ends of said vertical legs remote from said flat section of each of said sinuous springs being fixedly secured to said base frame, and each of said vertical legs of each of said U-shaped sinuous wire springs consisting of three edge loops interconnected by a pair of straight torsion bars, the endmost one of the edge loops remote from said flat section being connected to a third free end straight torsion bar, and said flat section of each of said U-shaped sinuous wire springs consisting of a single edge loop and a pair of straight torsion bars connected to opposite ends of said single edge loop, said flat section being secured to said top wire grid by snap-fit connector means, said snap-fit connector means comprising portions of each torsion bar of said pair of torsion bars of said flat section being spring biased outwardly over one wire of one of said first and second sets of wires of said grid and a portion of said single edge loop of said flat section being located beneath one wire of the other of said first and second sets of wires of said grid.

11. The foundation assembly of claim 10 wherein said single edge loop of each of said sinuous springs is of substantially larger radius than said edge loops of said vertical legs.

12. The bedding foundation of claim 10 wherein each of said pair of torsion bars of said flat section of said sinuous wire springs comprises a straight bar having an outwardly extending offset formed therein.

13. The bedding foundation of claim 12 wherein each of said portions of said single edge loop of said flat section of said sinuous wire springs is located beneath a vertically and upwardly offset section of said one wire of the other of said first and second sets of wires of said grid.

14. The bedding foundation of claim 13 wherein said vertically and upwardly offset section of said one wire is offset upwardly from the plane of said grid by approximately the diameter of the wire from which said sinuous wire spring is formed.

15. The bedding foundation of claim 14 wherein single edge loop of said flat section of said sinuous wire springs has a detent formed therein at the point at which it intersects said vertically and upwardly offset section of said one wire.

16. The bedding foundation of claim 14 wherein each of said vertically and upwardly offset sections has a downwardly extending indentation formed therein approximately medially of the length of said vertically and upwardly offset sections.

17. A box spring comprising a base frame, a top wire grid, and a plurality of sinuous wire springs interconnecting the top wire grid and the base frame, said sinous wire springs each comprising a sinous wire strip formed into an inverted U-shaped configuration, each of said U-shaped springs having a closed end attached to the top wire grid by snap-fit connector means, each of said U-shaped springs having substantially vertical legs with free ends attached to said base frame, and each of said closed ends of said sinuous wire springs comprising a pair of substantially parallel torsion bars interconnected by a single edge loop each of said vertical legs comprising at least a pair of substantially parallel torsion bars interconnected by an edge loop, the edge loop of said vertical legs having a radius less than a radius of the closed end loop.

18. The box spring assembly of claim 17 wherein each of said parallel torsion bars has an outwardly extending offset formed therein, said offsets being positioned over the top of a pair of parallel wires of said grid.

19. The body spring assembly of claim 18 wherein each of said single edge loops or said sinuous wire springs is positioned beneath a wire of said grid which extends perpendicular to said pair of parallel wires.

20. The box spring assembly of claim 19 wherein said perpendicular wire extends beneath said pair of parallel wires.

21. The box spring assembly of claim 19 wherein said each of said single edge loops of said sinuous wire springs extends beneath a vertically and upwardly offset section of said perpendicular wire.

22. The box spring assembly of claim 19 wherein each of said single edge loops of said sinuous wire springs has a detent formed therein at the point at which it intersects said vertically and upwardly offset section of said one wire.

23. The box spring assembly of claim 22 wherein each of said vertically and upwardly offset sections has a downwardly extending indentation formed therein approximately medially of the length of said vertically and upwardly offset sections.

* * * * *